US005749359A

United States Patent [19]

Hansen

[11] Patent Number: 5,749,359

[45] Date of Patent: May 12, 1998

[54] PORTABLE AIR CONDITIONER

[76] Inventor: Iver Hansen, Gjerdalsveien 3, N-3442 Hyggen, Norway

[21] Appl. No.: 360,768

[22] PCT Filed: Jun. 1, 1993

[86] PCT No.: PCT/NO93/00088

§ 371 Date: Dec. 1, 1994

§ 102(e) Date: Dec. 1, 1994

[87] PCT Pub. No.: WO93/24168

PCT Pub. Date: Dec. 9, 1993

[30] Foreign Application Priority Data

Jun. 1, 1992 [NO] Norway ..... 921853

[51] Int. Cl.[6] ..... A62B 7/10

[52] U.S. Cl. ..... 128/205.25; 128/201.25; 128/202.25; 128/205.29; 128/206.15

[58] Field of Search ..... 128/201.25, 204.15, 128/204.16, 204.18, 204.19, 204.21, 205.12, 205.25, DIG. 15, 207.12, 207.16, 202.27, 202.28, 202.11, 202.12, 201.15, 201.29, 205.29, 206.15, 202.25; 251/277, 278, 264

[56] References Cited

U.S. PATENT DOCUMENTS

| | | | |
|---|---|---|---|
| 2,506,296 | 5/1950 | Gaddini | 128/204.15 |
| 3,140,590 | 7/1964 | Gleockler | 128/204.15 |
| 3,717,148 | 2/1973 | Svab | 128/202.25 |
| 4,307,433 | 12/1981 | Takechi et al. | 128/202.25 |
| 4,331,141 | 5/1982 | Pokhis | 128/201.25 |
| 4,548,626 | 10/1985 | Ackley et al. | 128/201.25 |
| 4,676,236 | 6/1987 | Piorleouski et al. | 128/201.25 |
| 4,726,174 | 2/1988 | Wilson | 128/207.11 |
| 4,881,538 | 11/1989 | Angell | 128/201.25 |
| 4,905,686 | 3/1990 | Adams | 128/207.12 |
| 5,002,049 | 3/1991 | Knoll | 128/200.28 |
| 5,237,988 | 8/1993 | McNeese | 128/DIG. 26 |
| 5,394,870 | 3/1995 | Johansson | 128/205.29 |

FOREIGN PATENT DOCUMENTS

| | | | |
|---|---|---|---|
| 0320125 | 6/1989 | European Pat. Off. | 128/201.25 |
| 0649920 | 8/1937 | Germany | 128/201.25 |
| 27 33 729 | 2/1978 | Germany . | |
| 167246 | 1/1987 | Norway | A61N 1/44 |
| 0560877 | 4/1944 | United Kingdom | 128/201.25 |
| 2032284 | 5/1980 | United Kingdom | 128/201.25 |
| 2128897 | 5/1984 | United Kingdom | 128/201.25 |
| 2221164 | 1/1990 | United Kingdom | 128/201.25 |
| 2266247 | 10/1993 | United Kingdom | 128/201.25 |
| 92/16251 | 10/1992 | WIPO | A61M 15/02 |

OTHER PUBLICATIONS

International Search Report—Sep. 2, 1993.

*Primary Examiner*—Vincent Millin
*Assistant Examiner*—V. Srivastava
*Attorney, Agent, or Firm*—Oblon, Spivak, McClelland, Maier & Neustadt, P.C.

[57] ABSTRACT

A personal portable air conditioner or air purifier with a carrying arrangement, which includes a neck strap (11), delivers conditioned or purified air to the head/facial area of the user. The apparatus consists of a filter/fan unit (8,2), arranged to direct a concentrated flow of conditioned or purified air toward the user's mouth and nose. The filter/fan unit may also be kept secure in its position by a lower belt (FIG. 4) which is included in the carrying arrangement, or for instance by using braces or a tight fitting pocket in a useful position. The filter/fan unit is also equipped with a rapid fastening arrangement, for instance a Velcro/attachment (20), for one or several additional accessories for air regulation included as optional parts of the apparatus.

32 Claims, 4 Drawing Sheets

PORTABLE AIR CONDITIONER

BACKGROUND OF THE INVENTION

1. Field of the Invention

This invention is a portable air conditioning or air purifying unit for persons with health problems due to air quality. These health problems include headache, fatigue, depressions, etc. and possibly some types of allergic and asthmatic reactions as well.

2. Discussion of the Background

To improve air quality there are many devices available. However, most have the common disadvantage of purifying air only in the immediate surroundings without always securing sufficient purification and improvement of air closest to the users head/facial and breathing area.

Even when using expensive stationary air conditioners and purification equipment, users may still breathe polluted and noxious air when for instance cigarette smoke comes between the user and the air purifying unit Having some health problems due to air pollution, the inventor has been experimenting since 1977 making both stationary and portable air purifiers. He came to the conclusion that he benefited most when using an air purifier dose to his breathing organs. Therefore, he made air purifiers smaller and portable, because other purifiers on the market were stationary and consequently did not solve the health problems mentioned above.

In a German publication, DE 27 33 729 B 2, a stationary air purifier with a combination of ionizer and fan has been presented earlier. This purifier does not solve the above mentioned problems as it is stationary.

The inventor designed several small air purifiers which are portable and use a neck strap. He also designed portable ionizers having certain similar features as those types which were later patented by others, see Norwegian laid-open publication #167246 and international publication #WO 92116251. According to the inventor's experience, none of these ionizers offer a satisfactory solution to health problems like headache, fatigue, and other discomfort related to air pollution. This lack of effect also seems to be confirmed by doctors that have made investigations in this regard. Another disadvantage to ionizers is that they contain a high voltage unit and ere surrounded by an electric field which may cause discomfort to some persons. Short-term use of ionizers is considered acceptable by health professionals, but there are questions concerning long-term effects. Experiments show that long-term use of portable ionizers close to the body may cause discomfort to susceptible persons. The inventor has solved this problem by placing an ionizer to the outside of the main apparatus (FIG. 1) so that the electrical field has less exposure to the body compared with the portable ionizers mentioned above. Also, the inventor has designed additional equipment (optional) in the ionizer, inter alia a pot meter which allows the user to adjust the amount of ionization to fit individual need. In addition thereto, the inventor has an adjustable field regulator in his ionizer, thereby enabling an even greater adaptation to personal need. Also included is a lower belt attachment which stabilizes the ionizer, avoiding the pendulous movements of prior ionizers when walking and in motion.

In areas having variable and poor air quality, the air will normally consist of far more noxious gases and pollutants that can possibly be purified by a simple portable or stationary ionizer, because an ionizer has a limited range of operation. The inventor has for many years constructed and tested prototypes of portable air purifiers, and has come to the conclusion that ionizing alone is usually not sufficient. A more versatile air purification system is necessary to obtain satisfactory results. Obviously, there is a need to focus a multi-filtered stream of air directly to the breathing organs from a short distance, using a speed regulator. Experience shows that this gives the best health results, because the user of such a portable purifier generally gets the health advantages of improved air quality no matter where he is residing. Thus, there should be a clear demand for an apparatus which offers both versatility and adjustability to various user body shapes and health problems, i.e. an apparatus incorporating the possibility of individual adaptation to the particular user.

SUMMARY OF THE INVENTION

In order to solve the above problems for persons sensitive to air pollution, there is consequently an obvious need for such a portable apparatus offering a better and wider function than the simple principle of ionization alone. The need is met by making available an apparatus of the type precisely defined in the appended patent claims.

BRIEF DESCRIPTION OF THE DRAWINGS

The apparatus in accordance with the invention is hereby described more closely by referring to exemplary embodiments thereof and with reference to the enclosed drawings wherein.

DETAILED DESCRIPTION OF THE PREFERRED EMBODIMENTS

Figure 1:
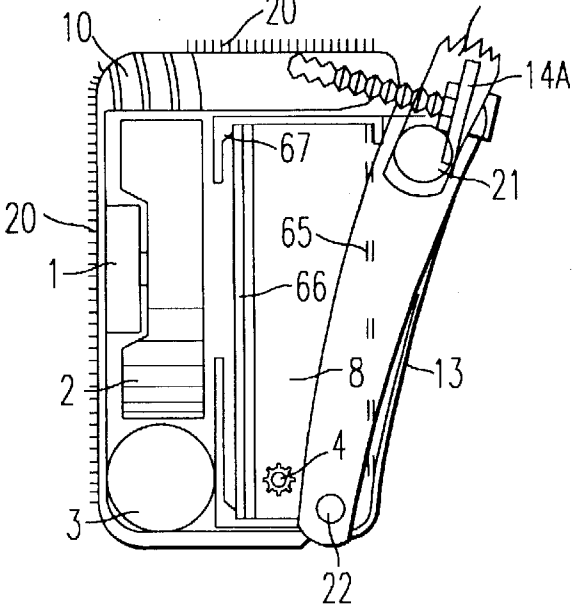
FIG. 1 shows a fan and filter unit, which constitute the central main part of the apparatus.
Figure 4:
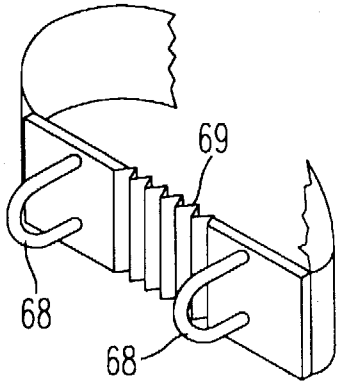
FIG. 4 shows the lower belt, which is quite essential to keep the main apparatus (FIG. 1) in a stable and secure position when the user is in motion by the use of straps or a tight fitting pocket or pouch in a suitable position.
Figure 6:
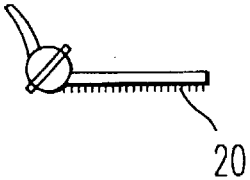
FIG. 6 shows an adjustable directing fin for the direction of airflow.
Figure 5:
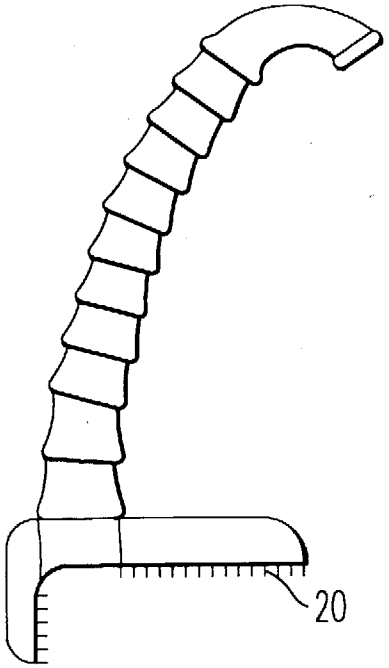
FIG. 5 shows a so-called swan's neck or mouth piece which may be used advantageously in heavily polluted areas or when wind deflects the air stream from the main apparatus.
Figure 11:
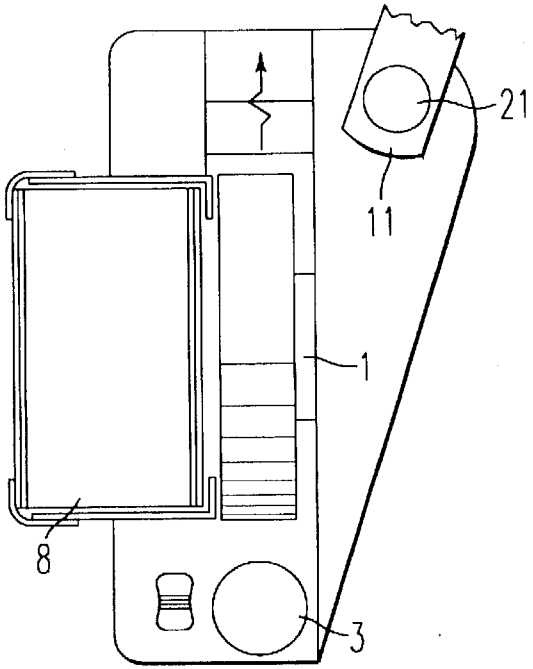
FIG. 11 shows an embodiment of the apparatus which provides the option of thicker filters for use in more polluted areas.
Figure 10:
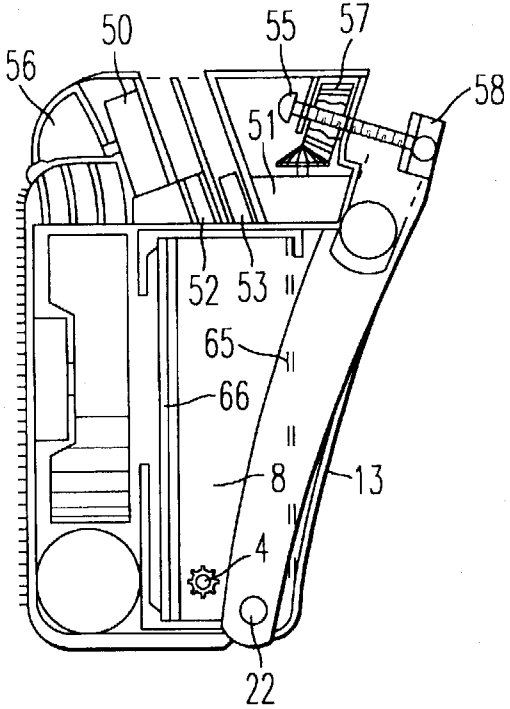
FIG. 10 shows an embodiment of the apparatus with an electronic auto control unit on top of the apparatus for automatic focusing of air flow towards the respiratory organs of the user.
Figure 9:
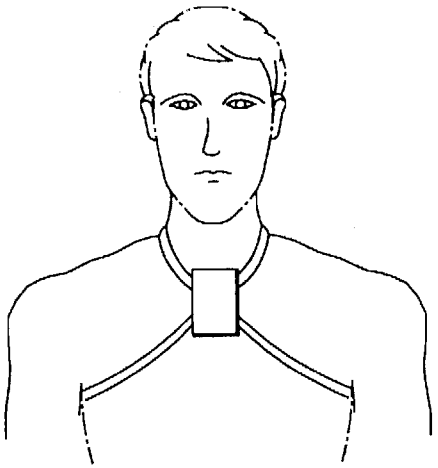
FIG. 9 shows the most commonly used position of the main apparatus on the body.
Figure 14:
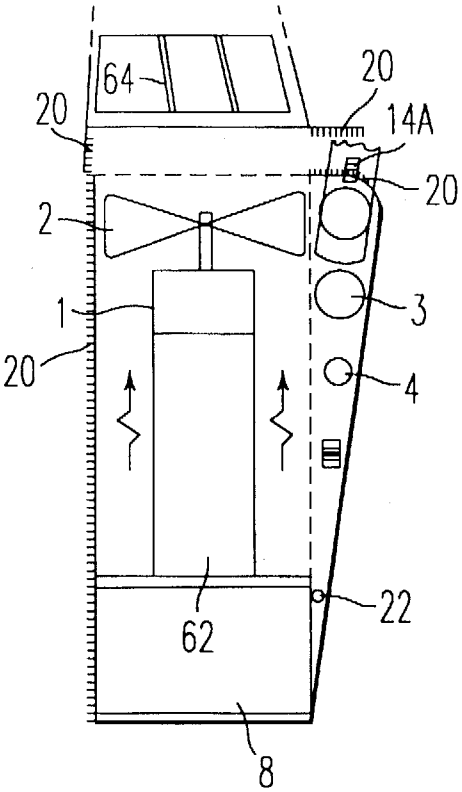
FIG. 14 shows an embodiment of the apparatus having a propeller type fan.
Figure 13:
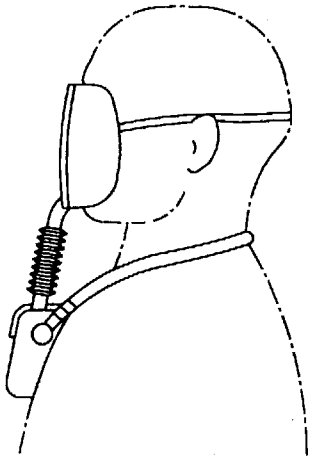
FIG. 13 shows the use of the air purifier in heavy air pollution where there is a danger of damage to eyesight.
Figure 12:
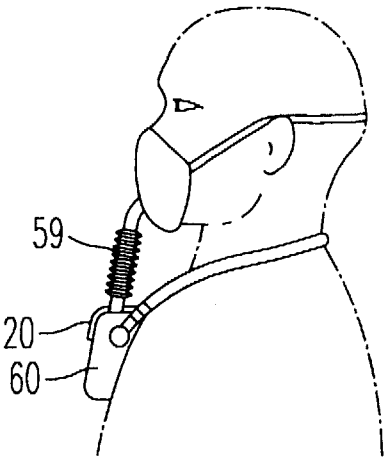
FIG. 12 shows the use of the apparatus in heavily polluted situations, where a mask is necessary to keep poisonous air away from the respiratory organs.

FIG. 1 shows a unit consisting of a fan (2) and a filter unit (8). The filter unit may comprise of an active carbon filter, a pre-filter (65) and a post-filter (66). The fan sucks the air by the rear hatch way (13) and through the filters (8,65,66). The air then passes through the fan (2) and is thereafter hurled toward the user's respiratory organs. Filters may easily be changed by opening the rear hatch way (13) by way of a simple rapid coupling system, e.g. a magnet attachment or a screw connection (14A). A full disconnection of the rear hatch way (13) is simply done by additionally bending outward the tongue like projections below the lower belt attachment (22). Pulling out the filter unit (8) and the filter cassette (67), makes the NiCd battery (3) and the fan (2) easily accessible. By loosening the fan center screw, the motor (1) is accessible for lubrication and maintenance. The battery may alternatively be reached by an exterior slide hatch as is the case in one of the inventor's prototypes. In another alternative, an exterior plug may be mounted for charging the battery, running the motor, cooling, electronics, etc. The wind direction fins (10) are quite necessary to catch and forward the rotating air from the centrifugal fan. The speed regulator (4) is quite necessary to obtain an air current of suitable speed from the apparatus. The lower belt attachment (22) has a small plug entering into the apparatus (FIG. 1) and another plug protruding for attachment of the hoop or ring (68) on the lower belt (FIG. 4). Between the rings (68) there is an elastic middle strap (69) which makes the hoops clasp firmly on to the lower belt attachment (22). This solution also makes it possible to use the lower belt invisibly, If the user accepts that the covering clothes enter between the belt attachment and the hoop (68). By turning an adjustment screw (14A), it is easy to adjust the apparatus so that the user receives an adequate flow of air directly toward the nose and mouth. The lengths of the lower belt (FIG. 4) and the neck strap (11) are adjustable by means of a rear slide buckle, e.g. of the so-called Fastex type. Air current exiting from the air duct (26) can be directed toward the user's head/facial area with air current steering devices, for example adjustment screw 14A, notches or tooth edged adjustment pin 14B, electromotor 50 to direct airflow sideways, electromotor 51 to direct airflow backward and forward, detectors 52 and 53, control electronics 55, bevel wheel control 57, side directional fin 56, magnetic swift lock 58, and manually adjustable directing fin 64. See also FIG. 6. In one embodiment, the air current steering device includes an electronic control means including, detectors (52, 53) for detecting head movement of the user and controllable devices, including electromotor 51 to direct airflow backward and forward, side directional fin 56, bevel wheel control 57 and magnetic swift lock 58, in or by an air outlet orifice for changing air fanning direction. In other embodiments, the air current steering devices include a manually adjustable means for channeling a flow of air towards the desired area, for instance a manually adjustable directing fin 64 (FIG. 14) or a flexible swan's neck (FIG. 5), both having a base attachable at the top of the apparatus by the use of a VELCRO attachment (20), a magnetic attachment or other rapid fastening arrangement. The air current steering device may include a flexible and elastic air duct (59) attached by means of a quick fastening arrangement, for instance a VELCRO attachment (20) to the filter/fan unit 60 (FIG. 12), and a mask which covers the nose and mouth (FIG. 12), optionally also the eyes (FIG. 13).

Most people have an indent in the middle of the chest due to the shape of the rib cage. The middle of the rear hatch (13) on the apparatus may have a convex shape corresponding to the indent of the rib cage. The lower belt (FIG. 4) pulls the apparatus against the indent to stabilize it's position. This solution offers more room for the filter unit (8) as well as counteracting pendulous movements of the apparatus when in motion. In one embodiment, the housing of the filter/fan unit includes an adjustable sloping rear hatch (FIG. 1, 13), adaptable to the user's chest angle and posture, by e.g., an adjustable screw (14A), notches or tooth edged adjustable pin (14B) arranged at the top or bottom of the apparatus for adjustment of the angle of the rear hatch.

Figure 2:
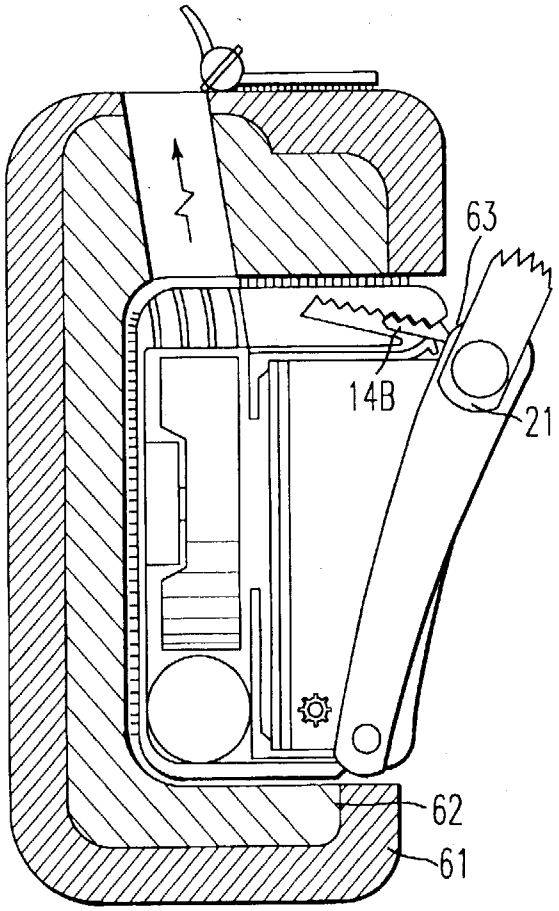
FIG. 2 shows the cooling and humidifying unit of the apparatus, which unit must be regarded as optional equipment that is used only under certain weather and temperature conditions.
Figure 7:
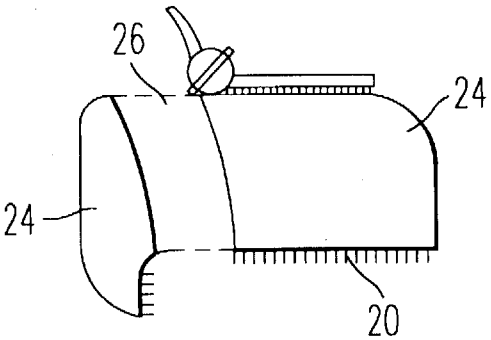
FIG. 7 shows a cooling and humidifying unit, lighter than the unit of FIG. 2 and more suitable for use when mobile.

The cooler and humidifier units (FIG. 2 and FIG. 7) may have a grating and or a pipe system for cooling and humidifying the air when it passes the air duct (26) on the top of the apparatus. Filters arranged in series (8) may comprise both of active carbon filters, electrostatic filters, and other filter types which contribute to the removal of harmful gases and particles, thereby improving the air for respiration. In one embodiment, the cooling/humidifying unit includes a thermoelectric cooling unit which can be fastened to the filter/fan unit by a VELCRO attachment (20), magnets or other quick fastening arrangement. In another embodiment, the cooling/humidifying unit may include a cooling means based on refrigerated material, for instance ice, dry ice or the like. In another embodiment, the cooling/humidifying unit consists of an outside insulated covering case (61), the interior cooling sheath (62) of the covering case having a shape adapted to the exterior shape of the filter/fan unit or, optionally to the exterior shape of the filter/fan unit when a further air influencing unit is attached thereto. The filter/fan unit may include a filter (8) optionally consisting of several partial filters of various types arranged in series, close to an air inlet (63), and a fan (2) which may be of a centrifugal or propeller type.

The electronic auto control unit (50–58) consists inter alia of:

An electromotor (50) to direct the air flow sideways when the user is turning his head to the side. An electromotor (51) to direct the air flow backward and forward.

Detectors (52,53), control electronics (55), a bevel wheel control (57), side directional fin (56), magnetic swift lock (58).

Figure 3:
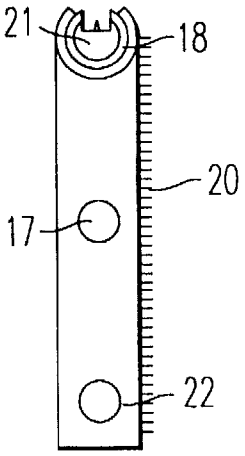
FIG. 3 also shows additional equipment, i.e. an ionizer, which is only used under particular air conditions.
Figure 8:
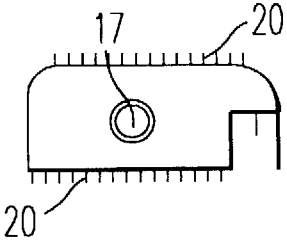
FIG. 8 shows a smaller ionizer which is more suitable for ionization of air entering the filters.

In a further embodiment, the filter/fan unit may include further air influencing units such as an ionizing unit (FIG. 3 and FIG. 8). The ionizing unit (FIG. 3) ionizes the air departing the apparatus and is easily attachable as a front part of the apparatus by means of a VELCRO attachment (20), magnetic attachment, or other rapid fastening arrangement. In this way, the ionizing unit is placed as far away from the user's body as practically possible, optionally, by having a smaller ionizing unit (FIG. 8) influencing the air and being correspondingly attachable as a top part of the apparatus. The ionizing unit is adjustable (17) regarding the amount of ionization, and optionally, includes directional adjustment of outgoing ions (18).

I claim:

1. A portable fan for directing a forced air stream toward a user's face without use of a facemask, comprising:

(1) a fan unit having a motorized fan, said fan unit having means for positioning said fan unit on the chest of the user;

(2) an air inlet in said fan unit;

(3) an air outlet in said fan unit, wherein air flows into said air inlet and flows out through said air outlet by action of said motorized fan;

(4) means connected to said fan unit and positioned entirely below the face of the user when said fan unit is positioned on the chest of the user for directing said forced air stream through and in contact with ambient air toward the user's face; and (5) means for adjusting the distance between said air outlet and the chest of the user.

2. The fan of claim 1, wherein said air stream directing means comprises air directing fins.

3. The fan of claim 1, wherein said air stream directing means is said air outlet.

4. The fan of claim 1, wherein said air inlet comprises an opening in said fan unit.

5. The fan of claim 1, wherein said air stream directing means further comprises an electric motor controllably attached to said air stream directing means.

6. The fan of claim 5, further comprising a head movement detector controllably connected to said electric motor.

7. The fan of claim 1, wherein said air stream directing means is removably connected to said fan unit.

8. The fan of claim 1, further comprising a filter positioned between said air inlet and said motorized fan for purifying air flowing into said fan unit through said air inlet.

9. The fan of claim 8, comprising a plurality of said filters.

10. The fan of claim 1, wherein said motorized fan is a centrifugal fan.

11. The fan of claim 1, wherein said fan is a propeller fan.

12. The fan of claim 1, further comprising an air ionizer in air flow communication with said air outlet.

13. The fan of claim 12, wherein said air ionizer is removably attached to said fan unit.

14. The fan of claim 11, wherein said air ionizer further comprises means for adjusting the quantity of ionization.

15. The fan of claim 11, wherein said air ionizer further comprises means for directionally adjusting ions produced by said air ionizer.

16. The fan of claim 1, further comprising an air cooling or humidifying unit for cooling air flowing out through said air outlet.

17. The fan of claim 16, wherein said cooling or humidifying unit is removably attached to said fan unit.

18. The fan of claim 16, wherein said cooling or humidifying unit is attached to said fan unit by VELCRO attachment or magnetic attachment.

19. The fan of claim 16, wherein said cooling or humidifying unit comprises means for holding a coolant.

20. The fan of claim 16, wherein said cooling or humidifying unit use an ice or dry ice cooling or humidifying unit.

21. The fan of claim 16, wherein said cooling or humidifying unit comprises an outer insulated covering case surrounding at least a portion of said fan unit and an inner cooling sheath between said outer insulated covering case and said fan unit, wherein said cooling sheath cools air within said fan unit.

22. A portable fan for directing a forced air stream toward a user's face, comprising:

(1) a fan unit having a motorized fan, said fan unit having means for positioning said fan unit on the chest of the user;

(2) an air inlet in said fan unit, wherein said air inlet comprises an opening in said fan unit and said opening is a rear hatchway allowing access into said fan unit;

(3) an air outlet in said fan unit, wherein air flows into said air inlet and flows out through said air outlet by action of said motorized fan;

(4) means connected to said fan unit and positioned entirely below the face of the user when said fan unit is positioned on the chest of the user for directing said forced air stream toward the user's face.

(5) means for adjusting the distance between said air outlet and the chest of the user.

23. The fan of claim 22, wherein said rear hatchway is hingeably attached to said fan unit and further comprises means for changing the angle of said rear hatchway relative to said fan unit about said hingeable attachment.

24. The fan of claim 22, wherein said rear hatchway is hingeably attached to said fan unit and further comprises an adjustable screw for changing the angle of said rear hatchway relative to said fan unit about said hingeable attachment.

25. The fan of claim 22, wherein said rear hatchway is hingeably attached to said fan unit and further comprises a notch or tooth edged adjusting pin for changing the angle of said rear hatchway relative to said fan unit about said hingeable attachment.

26. The fan of claim 22, wherein said rear hatchway has a convex shape.

27. The fan of claim 22, wherein said air inlet is through or around said rear hatchway.

28. A portable fan for directing a forced air stream toward a user's face without use of a facemask, comprising:

(1) a fan unit having a motorized fan, said fan unit having means for positioning said fan unit on the chest of the user;

(2) an air inlet in said fan unit;

(3) an air outlet in said fan unit, wherein air flows into said air inlet and flows out through said air outlet by action of said motorized fan;

(4) a fan speed regulator for regulating the speed of said motorized fan, to obtain a suitable speed of said forced air stream from said fan unit; and (5) means for adjusting the distance between said air outlet and the chest of the user.

29. A portable fan for directing a forced air stream toward a user's face without use of a facemask, comprising:

(1) a centrifugal fan unit having a motorized fan, said fan unit having means for positioning said fan unit on the chest of the user, said fan unit directing a forced air stream toward a user's face from a position entirely below the face of the user;

(2) an air inlet in said fan unit;

(3) an air outlet in said fan unit, wherein air flows into said air inlet and flows out through said air outlet by action of said motorized fan, said outlet position entirely below the face of the user;

(4) a fan speed regulator for regulating the speed of said motorized fan, said fan speed regulator adjustable for a suitable speed of said forced air stream from said fan unit; and (5) means for adjusting the distance between said air outlet and the chest of the user.

30. The fan of claim 29, further comprising filters positioned between said air inlet and said motorized fan.

31. The fan of claim 29, further comprising accessory means for channelling said forced air stream from said air outlet to a position closer to the user's face allowing the user open breathing organs and free unobstructed head movements.

32. A method according to claim 1 for directing a forced air stream toward a user's face without use of a facemask, comprising directing said forced air stream toward a user's face with the portable fan.

* * * * *